United States Patent [19]

Navi

[11] 4,046,370

[45] Sept. 6, 1977

[54] METHOD AND APPARATUS FOR INSERTING A BUNDLE OF NEWSPAPER INSERTS INTO A HOPPER

[75] Inventor: Menashe Navi, Lebanon, N.J.

[73] Assignee: ANPA Research Institute, Easton, Pa.

[21] Appl. No.: 772,174

[22] Filed: Feb. 25, 1977

Related U.S. Application Data

[63] Continuation of Ser. No. 599,227, July 25, 1975.

[51] Int. Cl.[2] ..... B65H 5/22

[52] U.S. Cl. ..... 271/3.1; 214/6 DK; 271/158

[58] Field of Search ..... 271/3.1, 7, 12, 145, 271/157–159, 314; 214/6 DK, 6 G

[56] References Cited

U.S. PATENT DOCUMENTS

| | | | |
|---|---|---|---|
| 2,414,059 | 1/1947 | Powers | 271/3 |
| 3,591,018 | 7/1971 | Nalbach | 214/6 G |
| 3,593,860 | 7/1971 | Brenner | 214/6 DK |

*Primary Examiner*—Richard A. Schacher
*Attorney, Agent, or Firm*—David H. Semmes; Warren E. Olsen

[57] ABSTRACT

Method and apparatus for inserting a bundle of newspaper inserts into a hopper station, particularly a method and apparatus for advancing a newspaper bundle into a position of support vertically above the hopper station, sensing the number of newspaper inserts within the bottom of the hopper and as the number of inserts approaches a critical low, dropping the newspaper bundle from the position of support downwardly into the hopper. The apparatus includes a newspaper insert level sensing means in the bottom of the hopper and a shovel platform reciprocably positioned above the hopper together with a guide, so as to support, then drop the bundle into the hopper.

5 Claims, 6 Drawing Figures

METHOD AND APPARATUS FOR INSERTING A BUNDLE OF NEWSPAPER INSERTS INTO A HOPPER

This is a continuation, of application Ser. No. 599,227, filed July 25, 1975.

BACKGROUND OF THE INVENTION

1. Field of the Invention

Newspaper insert feeding mechanisms, particularly a method and apparatus for feeding a bundle of newspaper inserts into a hopper inserting station. In the newspaper printing industry, a great deal of recent attention has been given to techniques for advancing inserts such as Sunday magazine supplements, advertising and the like into a hopper inserting station. More often than not, the inserts are printed independently of the newspaper and, therefore, require collation with the printed newspaper at the time of publication.

2. Description of the Prior Art

ANDERSON U.S. Pat. No. 3,883,131
WATSON U.S. Pat. No. 3,708,368
POLIT U.S. Pat. No. 3,705,719
HUMPHREY U.S. Pat. No. 3,599,965
NALBACH U.S. Pat. No. 3,521,108
HEPP U.S. Pat. No. 3,522,942
SPENCER U.S. Pat. No. 3,507,492
LAUREN U.S. Pat. No. 3,362,707
STROUD U.S. Pat. No. 3,298,683
LINK U.S. Pat. No. 2,853,299

The above-noted patents represent various delivery apparatus and methods specifically adapted for delivery of sundry types of folded forms onto a vertical stack. However, none of the above-noted references teach the combination of a hopper feeder which includes a horizontally positioned shovel for dropping a batch of inserts by gravity into a hopper for subsequent feeding to a later station. Particularly the articulated shovels of Lauren, Stroud, and Link depend upon controlled lowering of a batch, and not the provision of a frictionless shovel for dropping inserts vertically into a hopper as taught by the instant disclosure.

Unlike the method and apparatus according to the instant disclosure, these spades are required to move in both horizontal and vertical planes and do not allow for an instantaneous horizontal repositioning of a shovel vertically above a hopper.

Anderson illustrates a stacking sequence employing articulated trays A and B for batch placement onto a moving table. Watson illustrates a shuttle device for continuously positioning inserts between rollers, Polit is a like type of loading apparatus for continuously feeding inserts by shuttling to a subsequent sequence of rollers.

Humphrey illustrates another form of a continuous hopper feed with a level control.

Both Nalbach and Spencer require an endless chain for moving batches of articles vertically to a subsequent single feed from the bottom. The endless chain includes a counter for selective advancing of the supporting racks.

Hepp requires a vertically traveling conveyor in order to lower a supported batch slightly onto contact with carrier rollers.

SUMMARY OF THE INVENTION

According to the present invention a bundle of newspaper inserts is advanced onto a horizontal platform which may be reciprocably positioned above an insert hopper station containing a plurality of newspaper inserts. As the newspaper is printed, the inserts are fed from the bottom of the hopper into the folded newspaper edition.

A sensing device may be positioned in the bottom of the hopper, so as to sense a critical low of inserts. As the critical low is sensed, the shovel platform may be reciprocated beneath a vertical guide, so as to drop the bundle of newspaper inserts into the hopper. As the shovel platform is reciprocated back into position above the hopper, another bundle of newspaper inserts may be advanced linearly onto the platform.

BRIEF DESCRIPTON OF THE DRAWINGS

DESCRIPTION OF THE PREFERRED EMBODIMENTS

Figure 1:
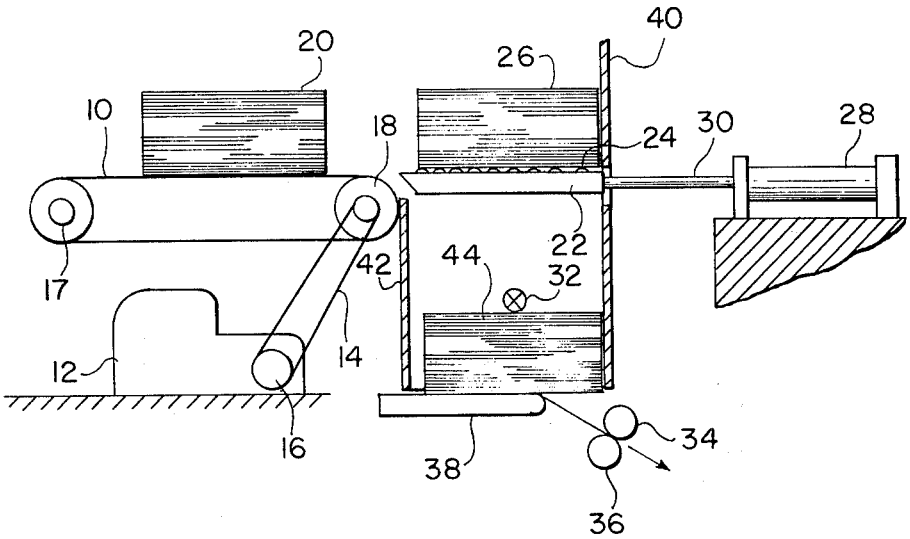
FIG. 1 is a schematic view of a proposed installation wherein the shovel platform is reciprocated above the hopper and axially with respect to an advancing conveyor.

In FIG. 1 there is shown a belt conveyor 10 of the endless type which may be mounted upon sheaves 17 and 18, driven in turn by motor 12 with drive shaft 16 and belt 14. A bundle of newspaper inserts 20 is shown positioned upon endless belt 10 prior to its advancement onto platform 22 above the hopper. Hopper 42 is shown supporting by means of feeding plate 38 a plurality of newspaper inserts 44 which are fed from the bottom through drive rollers 34 and 36. Details of the feeding plate 38, and drive rollers 34 and 36, constitute no essential part of the present invention, insofar as various forms of bottom feeding mechanisms are per se well known in the art. For example as previously noted, U.S. Pat. No. 3,705,719 in the name Polit illustrates a prior art shuttling device for bottom feed from a stack of inserts, to and between a pair of drive rollers. The conventional nature of a simple bottom feed plate, and drive assembly, as schematically illustrated herein at FIG. 1, is further evidenced to be a well known manner for bottom feed from a hopper by U.S. Pat. No. 3,988,016 wherein the present inventor is a named coinventor. The present invention is characterized by an apparatus for inserting a bundle of newspapers into a hopper station and is without criticality as to the form of an ultimate bottom feed mechanism employed according to the principles of the invention. A sensing element 32 of the electric eye type, for example, may be supported in the bottom of the hopper so as to sense a critical level of newspaper inserts.

Figure 2:
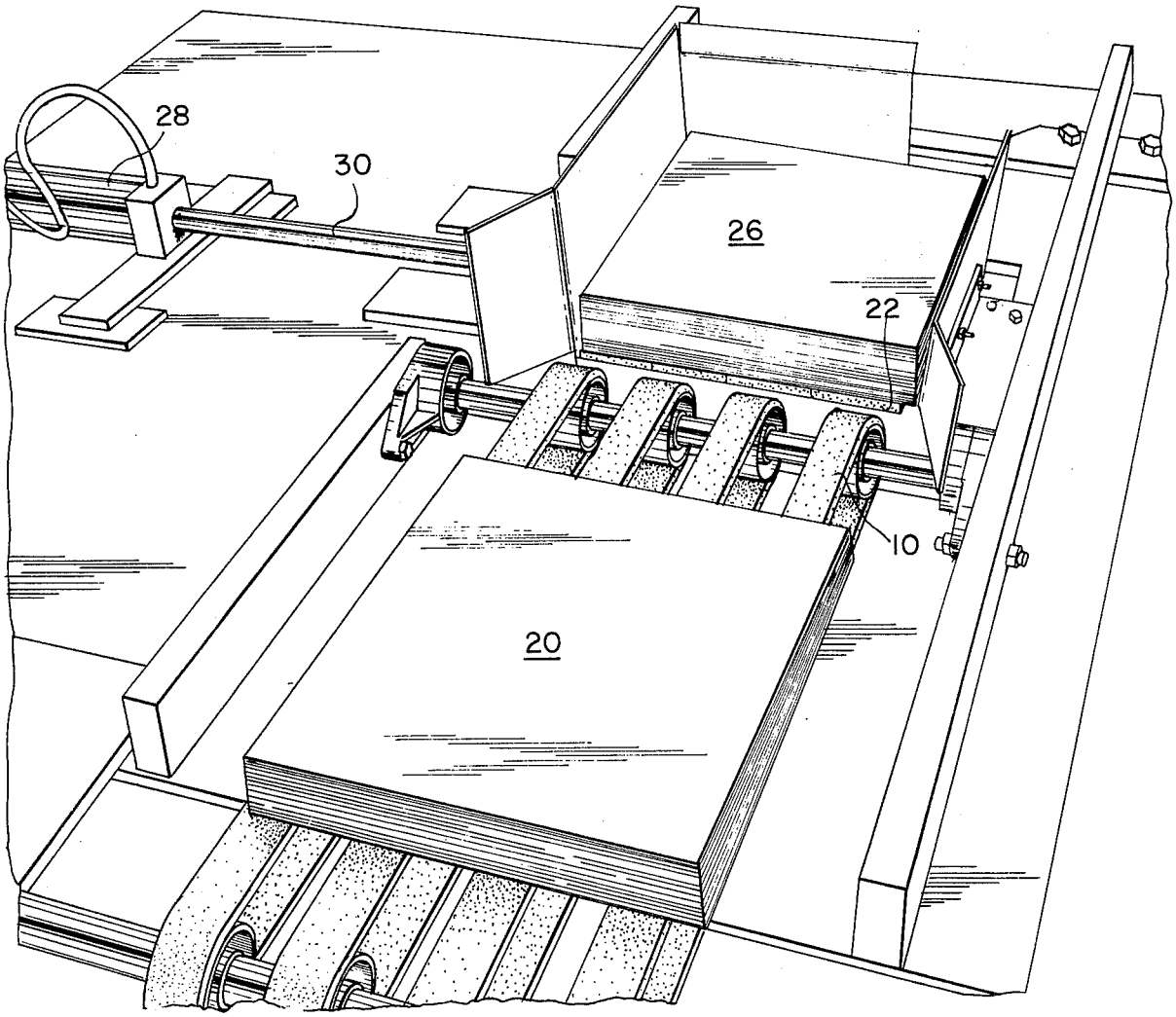
FIG. 2 is an enlarged, fragmentary perspective, showing an alternative arrangement wherein the shovel platform is reciprocated transversely of the advancing conveyor.
Figure 3:
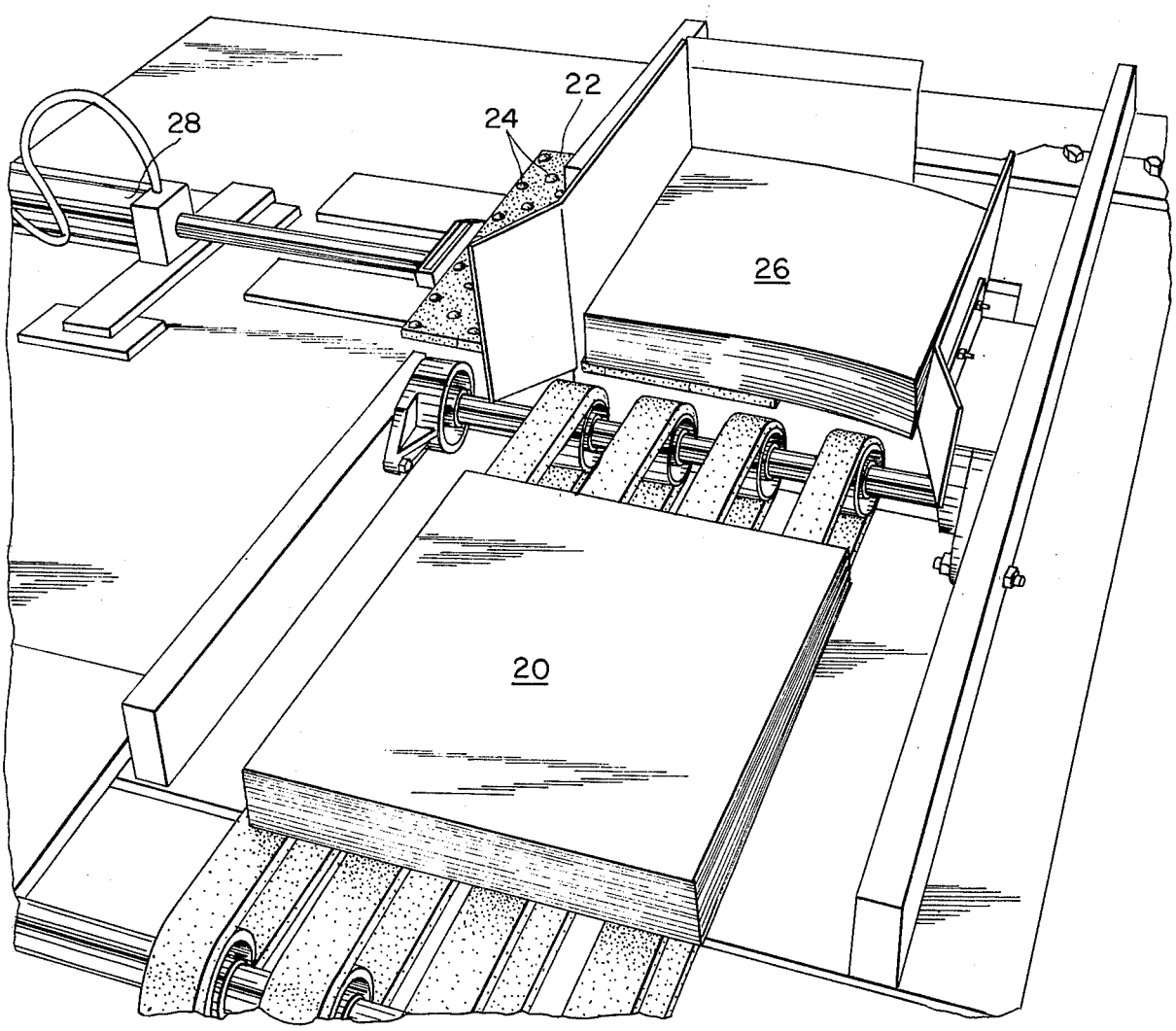
FIG. 3 is a similar view, showing the shovel platform reciprocated partially from beneath the bundle of newspaper inserts.
Figure 4:
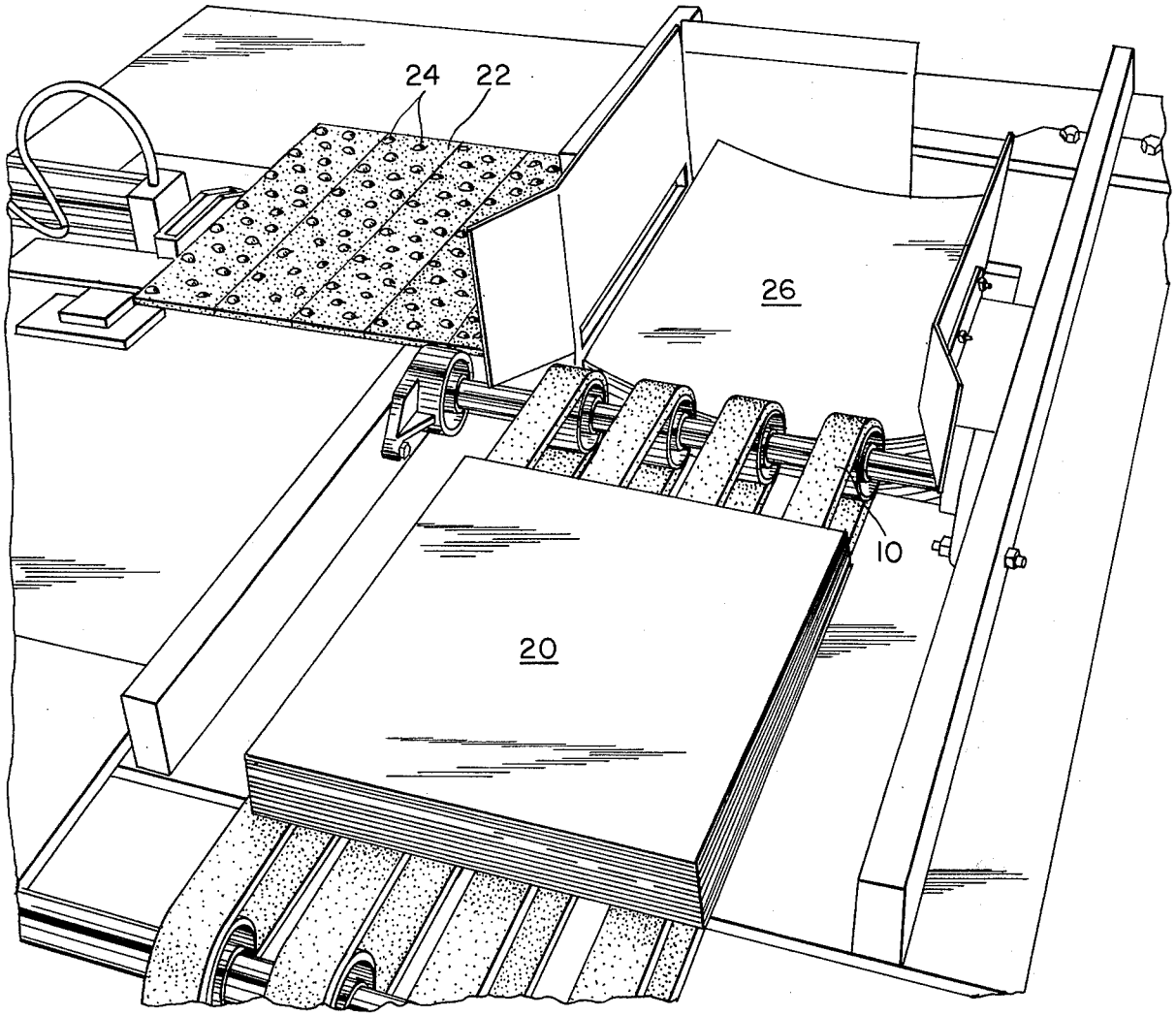
FIG. 4 shows the bundle dropped into the hopper, as the shovel is in its full withdrawn position.
Figure 5:
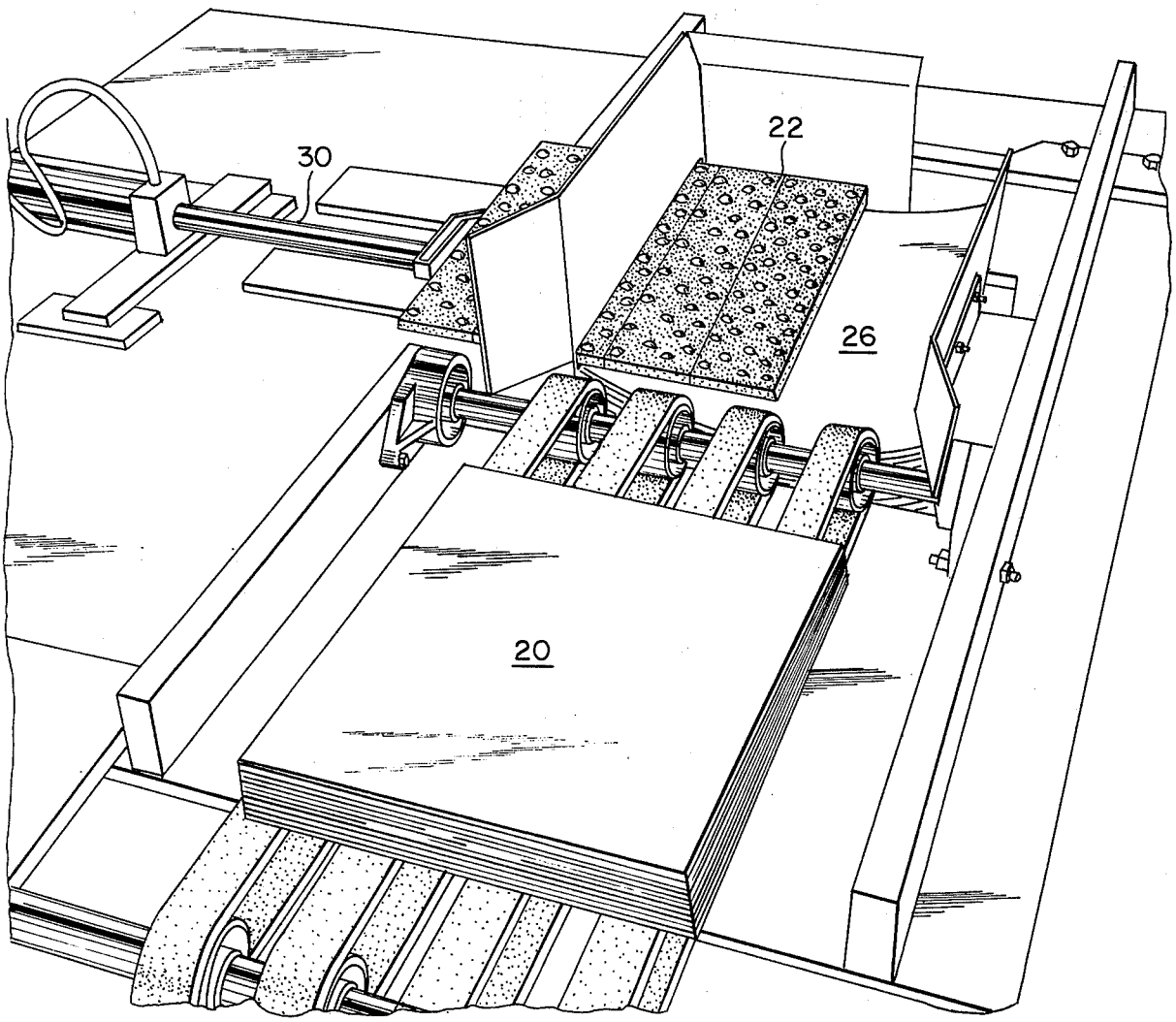
FIG. 5 shows the shovel platform being reciprocated back into position above the hopper.

Reciprocating shovel platform 22 having a plurality of vertical heads or protuberances 24 in its top surface may be mounted upon horizontal shaft 30 which is in turn reciprocated by hydraulic cylinder or the like 28, for horizontally reciprocating the platform from a first position, as shown in FIG. 2, to a second position, as shown in FIG. 4. A vertical guide plate 40 may be supported above hopper 42 and at right angles to shovel platform 22 so as to abut the bundle 26 of replenishment inserts.

As the critical low level of inserts is sensed within the hopper at 32, cylinder 28 may be activated to withdraw shaft 30 and platform 24 to its second position, outside of the hopper, so as to drop the bundle 26 of inserts into the hopper, as particularly illustrated in FIG. 4.

Figure 6:
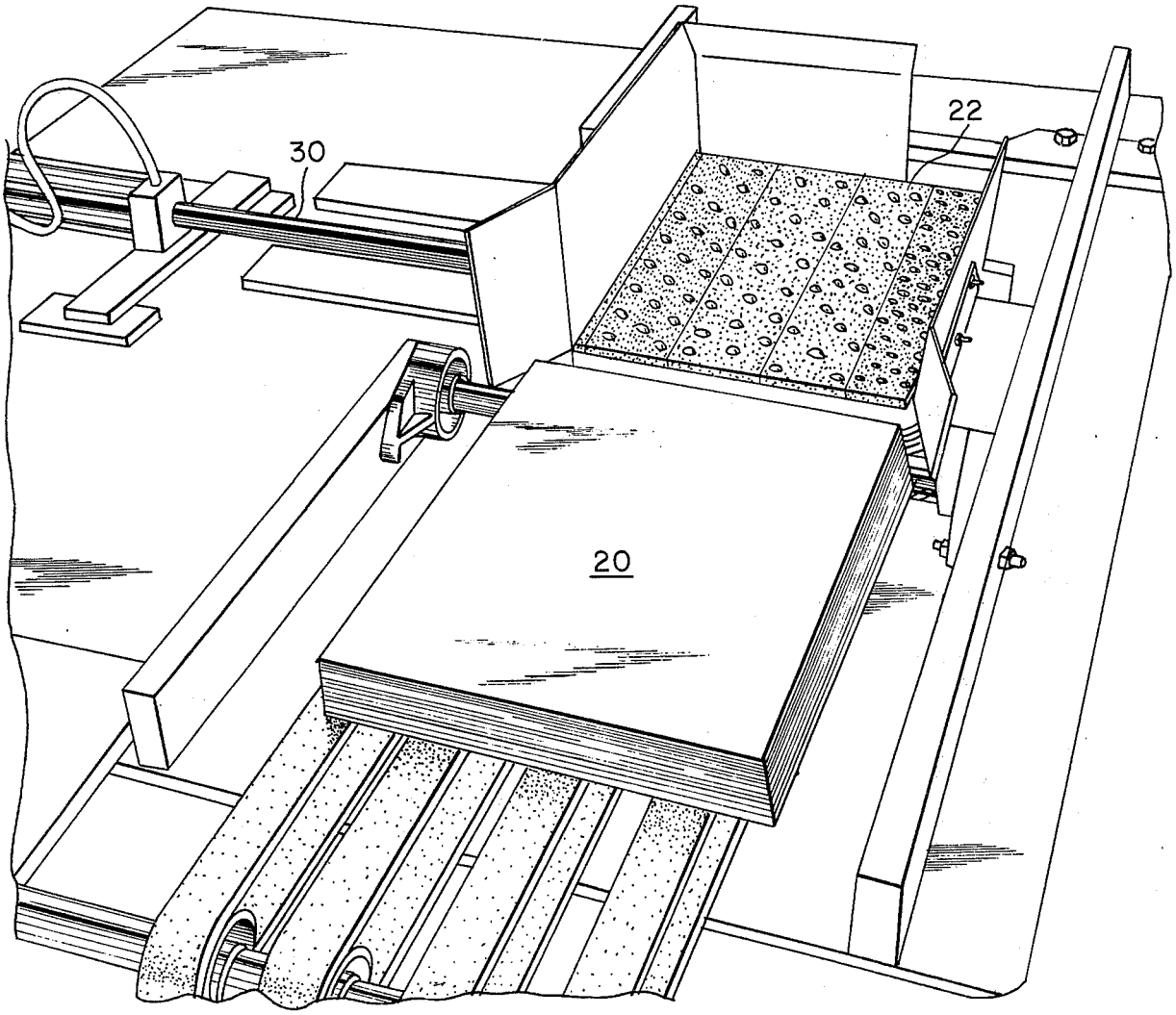
FIG. 6 shows the platform fully reciprocated in return to its full support position above the hopper.

As bundle 26 is dropped, the shovel platform 22 may be reciprocated to its full support position, as illustrated in FIG. 6 and conveyor 10 may be activated, thusly to deliver another bundle onto the shovel platform.

Manifestly, various types of bundles of materials may be inserted into the hopper and means may be employed for reciprocating the bundle without departing from the spirit and scope of the invention, as defined in the claims.

I claim:

1. Apparatus for inserting a bundle of newspaper inserts into a hopper comprising:

A. a frame;

B. an upwardly open, vertically disposed hopper for a first bundle of newspaper inserts supported at a lower point in said frame and including:

i. drive means for removing individual inserts from the bottom of said first bundle;

ii. a sensor positioned in the bottom of said hopper,

C. a horizontally disposed shovel platform positioned for a horizontal reciprocation in said frame above said hopper and in horizontal alignment with a belt conveyor, so as to support a second bundle of newspaper inserts vertically above said hopper in a first position; said shovel platform having a plurality of vertical heads extending vertically from the top surface of said platform, said shovel platform being horizontally reciprocable to a second platform position outside of said hopper to thereby drop said second bundle, as said sensor within said hopper senses a critical low number of inserts remaining in said first bundle in said hopper;

D. bundle vertical guide means supported in said frame above said hopper and adjacent and extending above said shovel platform top surface, so as to retain said second bundle for dropping downwardly into said hopper during a horizontal reciprocation of said shovel platform to said second position;

E. means responsive to said sensor for horizontally reciprocating said platform with respect to said hopper; and F. said endless belt conveyor supported adjacent said platform, so as to advance a replenishment bundle of newspaper inserts onto said shovel platform as said shovel platform is reciprocated back to said first position above said hopper.

2. An apparatus for inserting a bundle of newspaper inserts according to claim 1, wherein said endless belt conveyor is positioned to advance a replenishment bundle of newspapers in the direction which is transverse to the direction of reciprocation for said shovel platform.

3. Apparatus for inserting a bundle of newspaper inserts according to claim 1, wherein said endless belt conveyor is positioned to advance a replenishment bundle of newspapers in the direction which is axially with respect to the direction of reciprocation for said shovel platform.

4. Apparatus for inserting a bundle of newspaper inserts according to claim 1, wherein said vertically extending guide means further comprises a vertically extending surface, beneath which said shovel platform passes in said reciprocation from said first to said second position, wherein the reciprocation between said first and second positions is substantially instantaneous.

5. Apparatus for inserting a bundle of newspaper inserts according to claim 1, wherein said horizontally disposed shovel platform is horizontally reciprocated by direct connection to a horizontal shaft which is in turn horizontally reciprocated by a hydraulic cylinder between said first and second positions.

* * * * *